US005943988A

United States Patent [19]

Burger et al.

[11] Patent Number: 5,943,988

[45] Date of Patent: Aug. 31, 1999

[54] OPERATING ARRANGEMENT FOR A GAS CHANGE VALVE OF AN INTERNAL ENGINE COMBUSTION ENGINE

[75] Inventors: Dieter Burger, Vaihingen; Ulrich Letsche, Stuttgart; Jürgen Schüle, Adelberg, all of Germany

[73] Assignee: Daimler Chrysler AG, Stuttgart, Germany

[21] Appl. No.: 09/096,712

[22] Filed: Jun. 12, 1998

[30] Foreign Application Priority Data

Jun. 15, 1997 [DE] Germany ..... 197 25 218

[51] Int. Cl.[6] ..... F01L 9/04; F01L 9/02; F01L 1/24

[52] U.S. Cl. ..... 123/90.11; 123/90.14; 123/90.55

[58] Field of Search ..... 123/90.11, 90.12, 123/90.13, 90.14, 90.48, 90.55

[56] References Cited

U.S. PATENT DOCUMENTS

| | | | |
|---|---|---|---|
| 4,875,441 | 10/1989 | Riheson et al. | 123/90.13 |
| 4,883,025 | 11/1989 | Richeson, Jr. | 123/90.11 |
| 4,899,700 | 2/1990 | Richeson, Jr. et al. | 123/90.11 |
| 4,967,702 | 11/1990 | Richeson et al. | 123/90.14 |
| 5,022,358 | 6/1991 | Richeson | 123/90.11 |

FOREIGN PATENT DOCUMENTS

| | | |
|---|---|---|
| 0 328 195 | 8/1989 | European Pat. Off. . |
| 0 377 252 | 7/1990 | European Pat. Off. . |
| 33 11 250 | 8/1985 | Germany . |
| 38 36 725 | 12/1989 | Germany . |
| 195 01 495 | 11/1995 | Germany . |

*Primary Examiner*—Weilun Lo
*Attorney, Agent, or Firm*—Klaus J. Bach

[57] ABSTRACT

In an operating arrangement for a gas change valve of an internal combustion engine including an electromagnetic structure having an armature which is connected to the valve and which forms an operating piston disposed in a cylinder for reciprocating movement therein between an upper end position in which the valve is closed and a lower end position in which the valve is open, at least a first electromagnet is arranged adjacent the lower end position of the armature for retaining the armature when the electromagnet is energized, a spring is provided for biasing the valve to a closed position and electro-pneumatic means are provided for supplying gas under pressure to an operating chamber at one side of the piston for actuating the piston in a valve opening direction.

10 Claims, 11 Drawing Sheets

OPERATING ARRANGEMENT FOR A GAS CHANGE VALVE OF AN INTERNAL ENGINE COMBUSTION ENGINE

BACKGROUND OF THE INVENTION

The invention resides in an operating arrangement for a gas change valve of an internal combustion engine including an electro-pneumatic operating mechanism.

There are various types of operating mechanisms known in the art for operating gas change valves hydraulically or electro-hydraulically.

DE 33 11 250 C2 discloses an arrangement for the electromagnetic operation of a gas change valve for displacement machines with an armature connected to a valve and a spring system associated with the movable mass of the system. Electromagnets are arranged at opposite sides of the armature for retaining the gas change valve in two different control positions at the respective end positions of valve movement. In order to dampen the impact of the armature on the electromagnets and also the seating of the gas change valve on the valve seat, a dampening flow medium is provided in a space which delimits the pole surface of the electromagnet holding this valve in a closed position and the respective pole face of the armature.

EP 03 28 195 A2 discloses an arrangement for operating a gas change valve for an internal combustion engine by an electro-pneumatic mechanism with an armature connected to the valve. The armature forms an operating piston. In addition, at least one electromagnet and pneumatic pressure devices are provided which act on operating chambers for actuating the valve in an opening and closing direction.

This arrangement, however, is relatively complicated and expensive and there is furthermore, a non-harmonic power requirement for the opening and closing of the valve.

It is therefore the object of the invention to provide an arrangement for the operation of a gas change valve of an internal combustion engine which does not have the disadvantages of the state-of-the-art devices, particularly a valve operating mechanism which requires relatively low operating forces and by which the valve can be controlled in a highly variable manner.

SUMMARY OF THE INVENTION

In an operating arrangement for a gas change valve of an internal combustion engine including an electromagnetic structure having an armature which is connected to the valve and which forms an operating piston disposed in a cylinder for reciprocating movement therein between an upper end position in which the valve is closed and a lower end position in which the valve is open, at least a first electromagnet is arranged adjacent the lower end position of the armature for retaining the armature when the electromagnet is energized, a spring is provided for biasing the valve to a closed position and electrop-neumatic means are provided for supplying gas under pressure to an operating chamber at one side of the piston for actuating the piston in a valve opening direction.

By coupling one or two electromagnets with a high pressure and a low pressure device, which are preferably storage devices, the opening periods and the opening strokes of the valve are controllable in a wide range. In this way, asymmetric force relationships for the opening and closing of the valve can be easily accommodated. In this arrangement, the closing spring makes sure that during malfunctions the valve is in its closed position or is moved to its closed position.

The arrangement according to the invention further requires smaller magnets which also require less electric energy. In addition, the operating mechanism is relatively small and the times required for opening and closing the valve are relatively short.

Advantageous embodiments of the invention will become more readily apparent from the following description of the invention on the basis of the accompanying drawings.

DETAILED DESCRIPTION OF PREFERRED EMBODIMENTS

Figure 1:
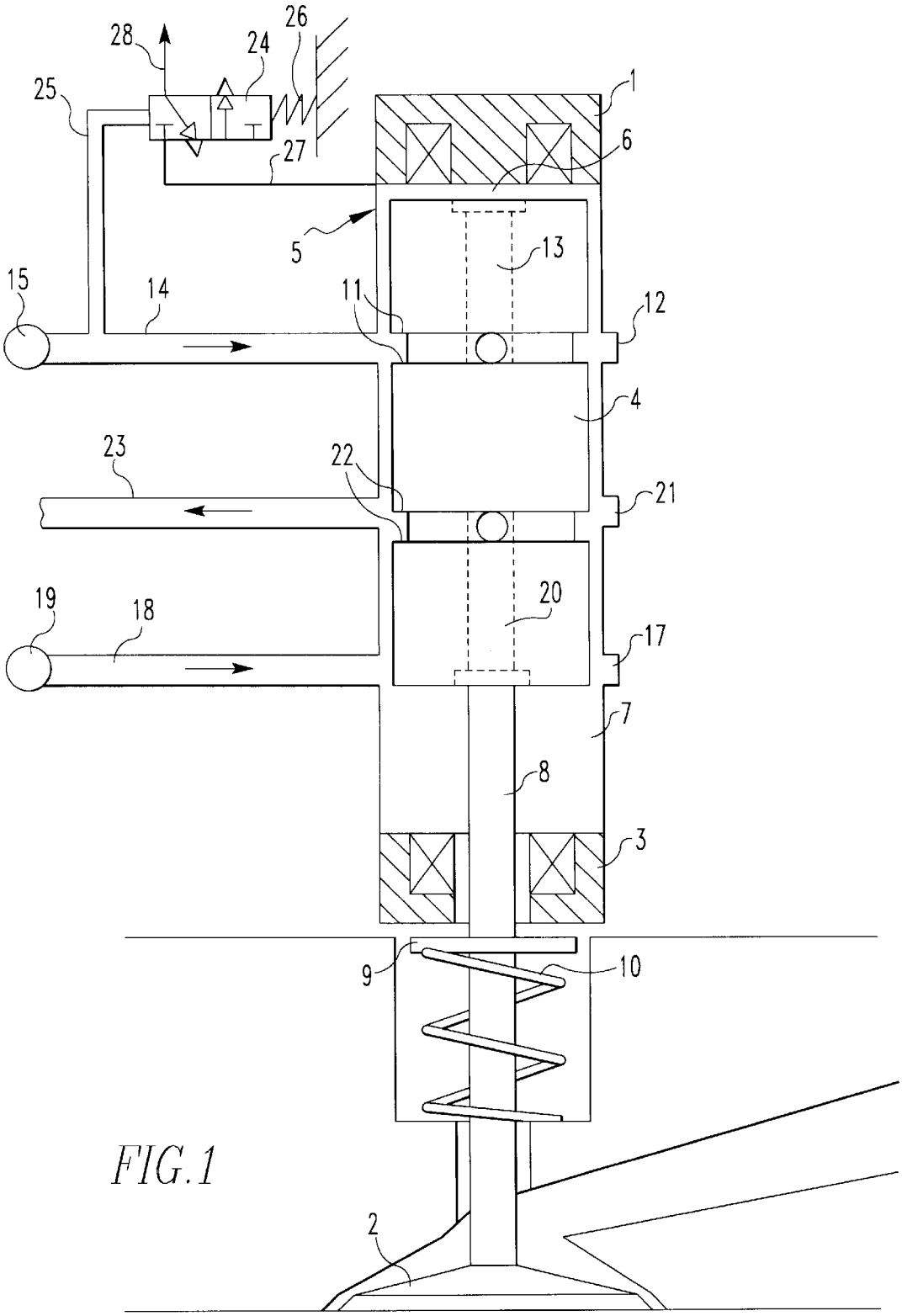
FIG. 1 shows a first embodiment of the arrangement according to the invention including an electro-pneumatic operating mechanism for gas change valves.

As shown in FIG. 1, an electro-pneumatic operating arrangement includes an upper electromagnet 1 for closing a valve 2 and a lower electromagnet 3 for opening the valve 2. Between the two electromagnets 1 and 3, there is an armature in the form of a pneumatic operating piston 4. The operating piston 4 is freely movable in a cylinder housing 5 as long as no magnet or pressure force acts on the piston 4. Between the upper electromagnet 1 and the operating piston 4, there is a first operating chamber 6, which forms an upper air spring. Between the lower electromagnet 3 and the operating piston 4, there is a second operating chamber 7, which also forms an air spring. The operating piston 4 is firmly connected to a valve shaft 8, or respectively an extension thereof. The valve shaft 8 is provided with an annular flange 9. Between the annular flange 9 and the cylinder housing 5 or another stationary part, a closing spring 10 is disposed under tension which applies a closing force to the valve 2.

The operating piston 4 includes control edges 11 and a communication bore 13 extends axially through the operating piston 4 and is in communication with an annular channel 12, by way of which the upper operating chamber 6 is in communication with a high pressure storage 15 via a communication conduit 14.

When the valve is open, the operating chamber 7 is in communication with another pressure storage structure 19 by way of a communication conduit 18, an annular channel 17 and a communication bore 20.

Also, by way of the axial communication bore 20, and an annular chamber channel 21 with control edges 22, the second operating chamber 7 is in communication with an air discharge conduit 23.

The electro-pneumatic operating mechanism operates as follows:

When the valve 2 is closed, that is, when an engine piston which is not shown, is in the top dead center position, the upper operating chamber 6 is in communication with the high pressure storage 15 because of the position of the upper control edges 11. At this point, the upper electromagnet 1 is energized so that the operating piston 4 is attracted thereby and is retained in its upper end position. The upper air spring 6 is then compressed. When the valve 2 is to be opened, the upper electromagnet 1 is de-energized. The piston 4, which is connected to the valve 2 or rather the valve shaft 8, then moves downwardly under the force of the air pressure of the upper air spring 6. After an initial movement phase, the pressurized air supply from the high pressure conduit 14 is closed by the control edges 11 of the operating piston 4. However, the operating piston 4 continues to move downwardly driven by the energy stored in the air spring 6. The lower operating chamber, which serves as the air spring 7, is in communication with the ambient air pressure by way of the air discharge conduit 23, when the valve 2 is closed because of the location of the control edges 22. When the valve 2 is opened, the lower air spring 2 is tensioned by the compression of the air in the second operating chamber 7 since communication with the air discharge conduit 23 is interrupted by the control edges 22. When the operating piston 4 is shortly before its lower end position, that is, the valve 2 has arrived at its open end position, the upper operating chamber 6 is placed in communication with the air release conduit 23 by way of the communication bore 13 and the annular channel 21 in the cylinder housing because of the location of the control edges 11. In this position, at the same time, the lower operating chamber 7 is placed into communication with the pressure source 19 by way of the communication bore 20, the annular channel 17 and the communication conduit 18, because of the location of the control edges 22 so that the lower air spring 7 is tensioned.

At this point, that is, shortly before the valve 2 reaches its lower end position, the lower electromagnet 3 is energized in order to retain the operating piston 4, which is also the armature whereby the valve 2 is held in its lower end position. When the valve 2 is to be closed again, the procedure proceeds correspondingly in opposite order.

Since the two operating chambers or air springs 6 and 7 are balanced with the ambient air pressure after each stroke, temperature influences on the operation of the system are hardly noticeable.

The electro-pneumatic arrangement operates in accordance with the resonance principle, that is, energy input occurs only in the end positions of the valve and only to the extent that the energy of the system was lost by friction and gas forces. In this way, the arrangement operates with very little energy consumption.

In order to compensate for the load-dependent influence of the combustion chamber pressure, the energy input may have to be adjusted; but this can easily be done with this system. To this end, all that is needed is to supply to the upper air spring 6 from the high pressure storage 15 an air pressure which is optimal for the respective engine operating point. The amount of energy supplied can be controlled by the level of the supply air pressure in the high pressure storage 15.

For the operation of this arrangement, the closing spring 10 is basically not needed. However, if valve 2 must be closed when the engine is not running, the closing spring 10 is used which will always return the valve to a closed position when the engine is shut down and the magnets are de-energized. However, for this reason, the spring can be weak when compared with conventional valve closing springs.

For safety reasons, there is provided for the upper air spring 6 a safety valve arrangement 24, which is normally kept closed by a communication line 25 extending to the high pressure conduit 14. However, if the pressurized air supply from the pressure storage 15 fails, a spring 26 normally compressed by the pressurized air permits the safety valve arrangement 24 to establish a connection, by way of a vent line 27 to the upper operating chamber 6 and another connection to an air vent line 28, whereby the upper operating chamber is depressurized so that the spring 10 can safely return the valve 2 to a closed position.

FIGS. 2 to 6 show a second embodiment of the invention wherein, instead of the lower air spring, a relatively strong closing spring 10 is used. In this arrangement, the parts corresponding functionally to the parts of the embodiment of FIG. 1 are indicated by the same reference numerals.

The operating chamber 6 is placed in communication with the high pressure storage 15, or respectively, the low pressure gas receiver 19' by communication bore 13*a* and 13*b*, or respectively, 20*a* and 20*b*.

Figure 2:
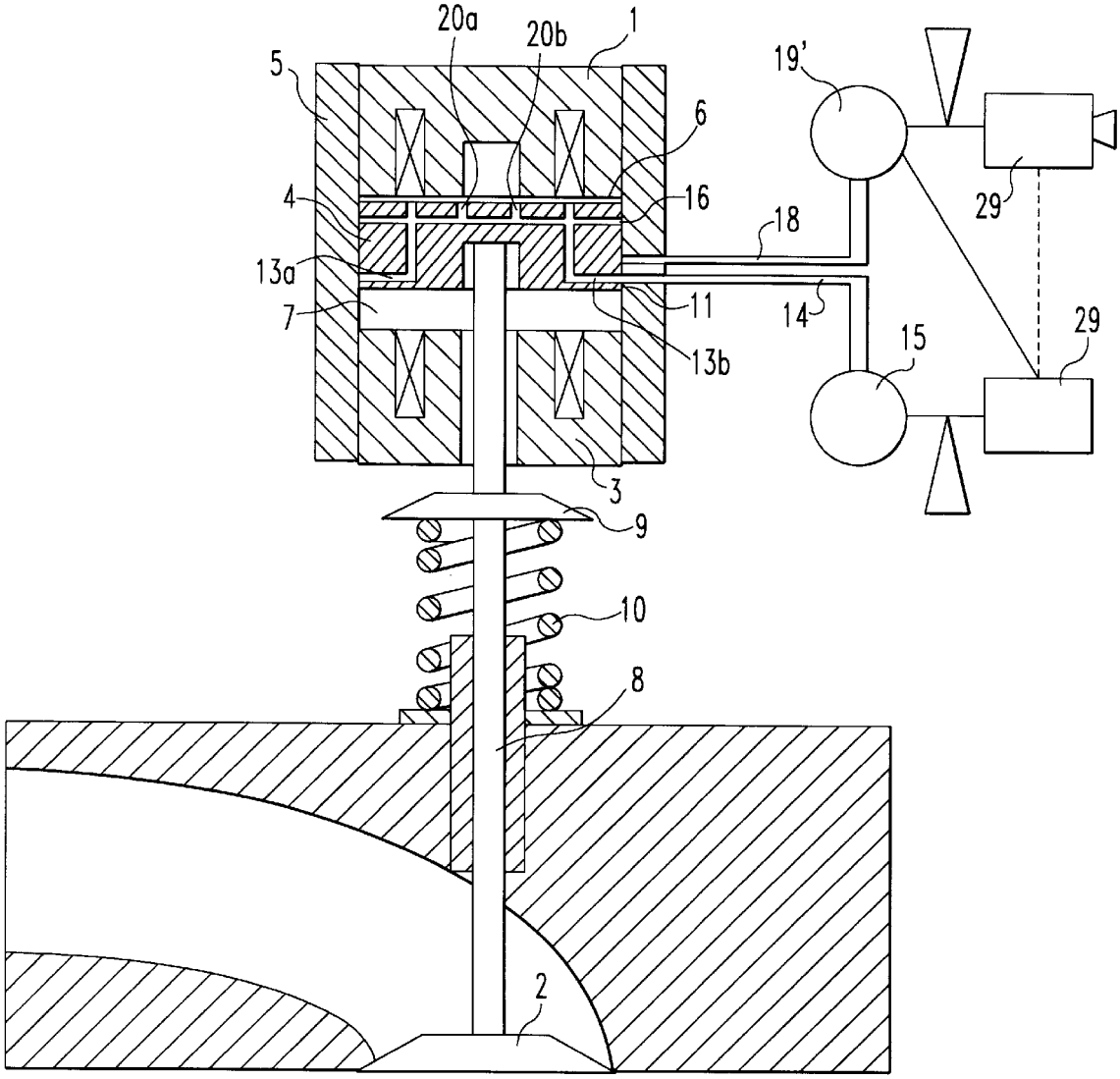
FIGS. 2 to 6 show another embodiment of the arrangement according to the invention in various valve positions.

FIG. 2 shows the base position, wherein the valve 2 is closed. The electromagnet 1 is energized and holds the valve 2 in its closed position. The operating chamber 6 is pressurized with pressurized air admitted by the communication with the high pressure storage 15. In order to move the valve to an open position, the electromagnet 1 is de-energized. As a result, the operating piston 4 is accelerated downwardly as it is no longer held by the electromagnet 1. At the same time, that is, at the beginning of the downward movement, the communication between the high pressure communication conduit 14 and the operating chamber 6 is interrupted by the control edges 11. With the expansion of the gases in the operating chamber 6, the operating piston is further accelerated downwardly.

Figure 3:
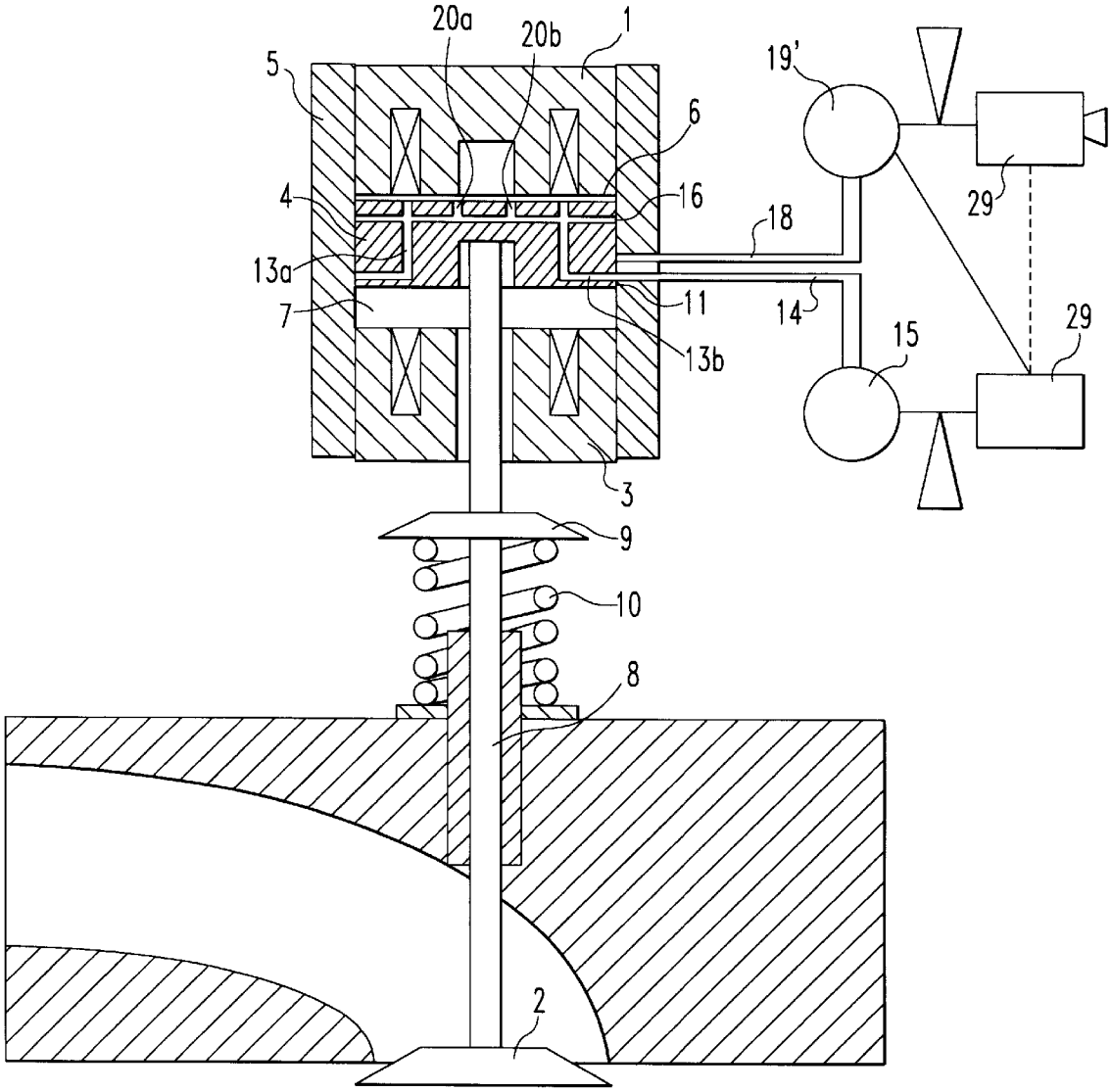

FIG. 3 shows an intermediate position, wherein the valve 2 is moved toward an open position, while the closing spring 10 is compressed. In this position, the high pressure storage 15 as well as the low pressure gas receiver 19' are disconnected. After a certain travel distance, the gas pressure in the operating chamber 6 acting as a gas spring is consumed and the valve closing spring 10 generates a greater counter force than the gas spring 6. This causes a deceleration of the valve 2, which ideally is such that the valve reaches its opened end position at a speed of zero in order to keep shocks in the system at a minimum to prevent damages.

Figure 4:
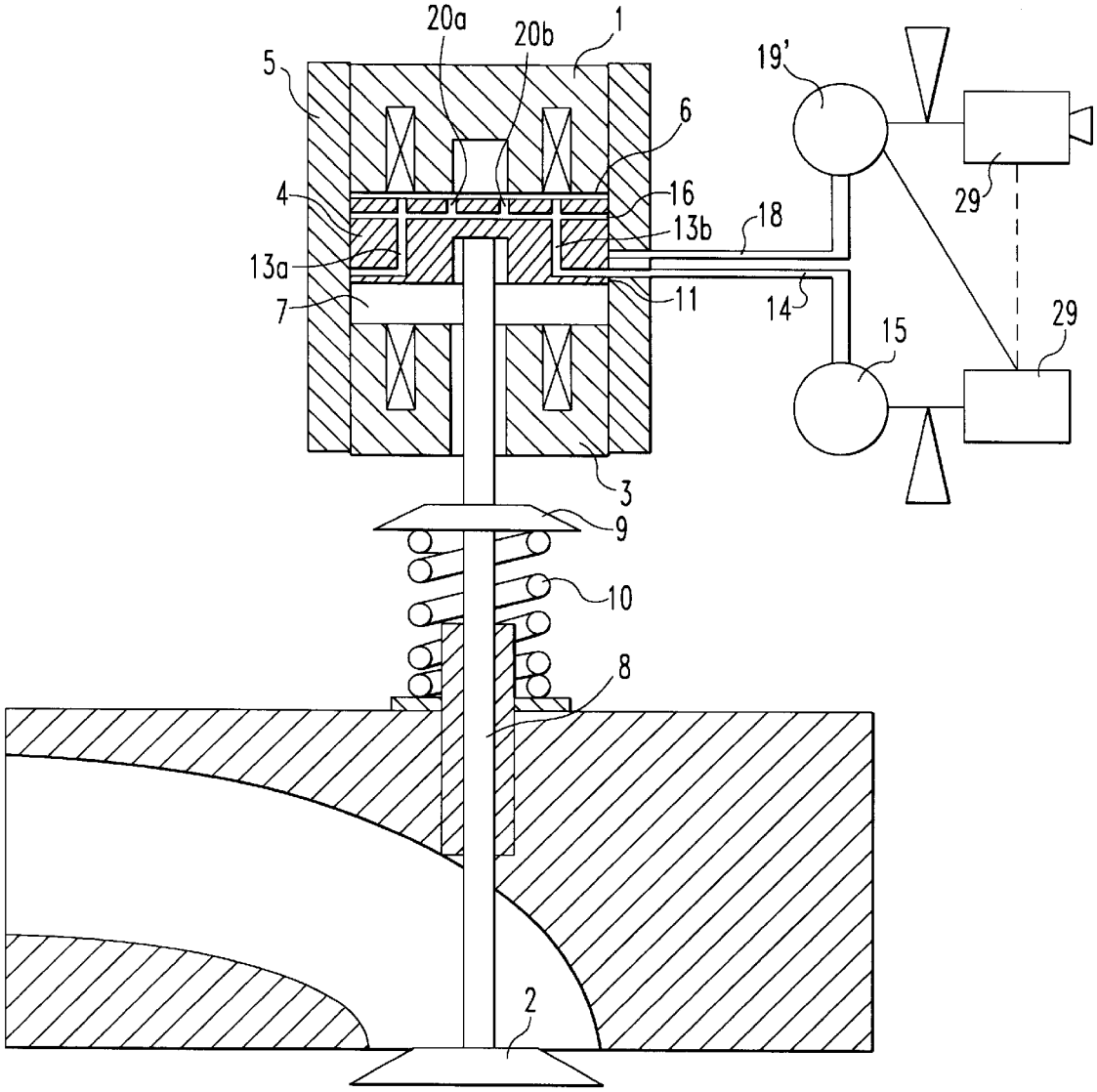

FIG. 4 shows the operating piston 4 shortly before reaching the lower end position, that is, the maximum opening position of the valve 2. In this position, communication is established between the operating chamber 6 and the low pressure gas receiver 19' by way of the communication bores 20*a*, 20*b*, the control slots 16 and the communication conduit 18. In this way, air pressure is released from the operating chamber 6 to the low pressure gas receiver 19' to facilitate the subsequent closing of the valve 2 as less energy is then required to compress the gas in the operating chamber 6 during the valve closing procedure. It provides for excess energy in the system, whereby friction and other system losses are made up for. In the lower position of the valve 2, that is, in its open position, the operating piston 4 is firmly held by the electromagnet 3, which is then energized. For closing the valve 2, the electromagnet 3 is de-energized whereupon the closing spring 10 moves the valve 2 to its closed position. During the closing process, the gas that has remained in the operating chamber 6 is compressed.

Figure 5:
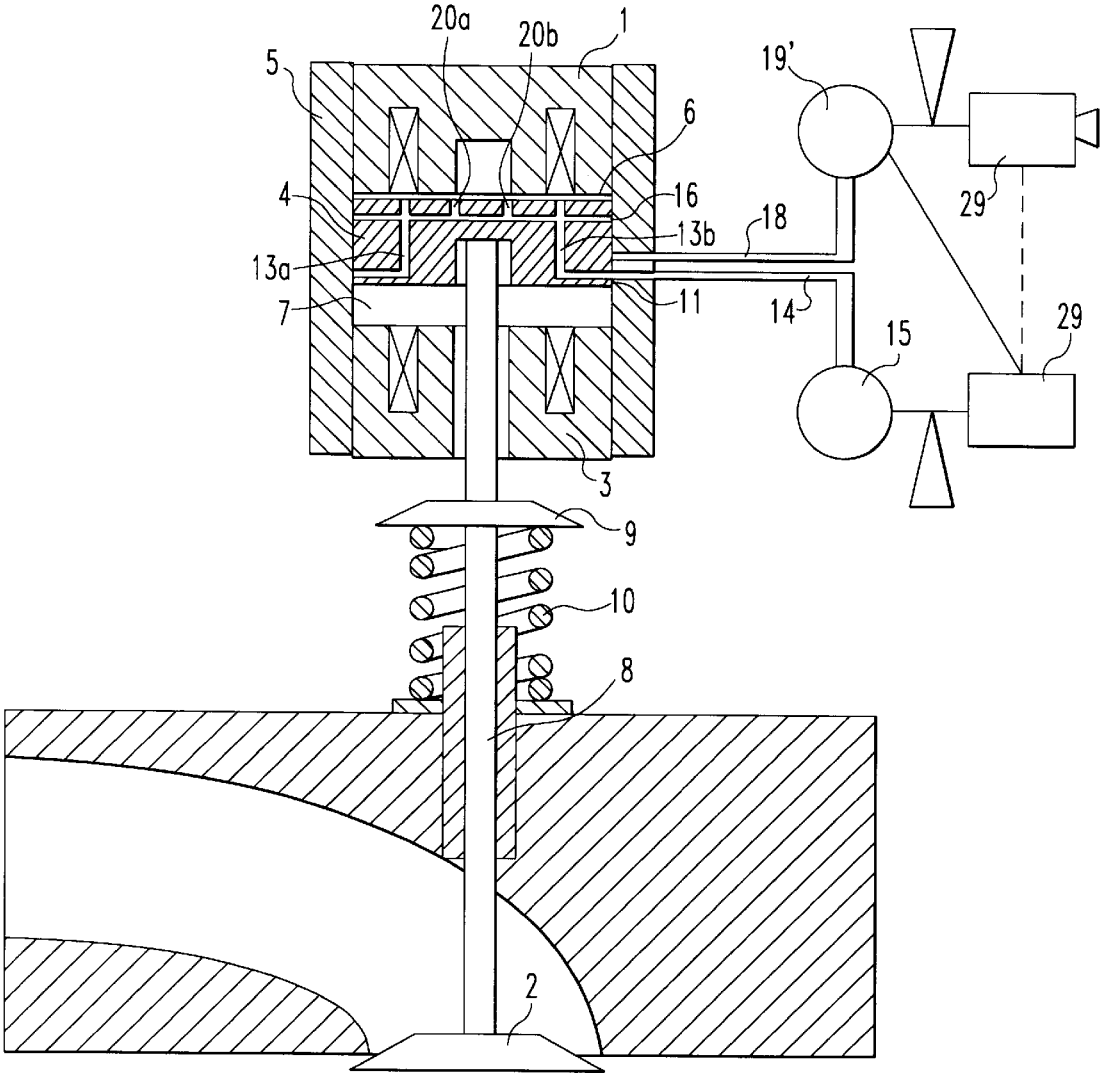
Figure 6:
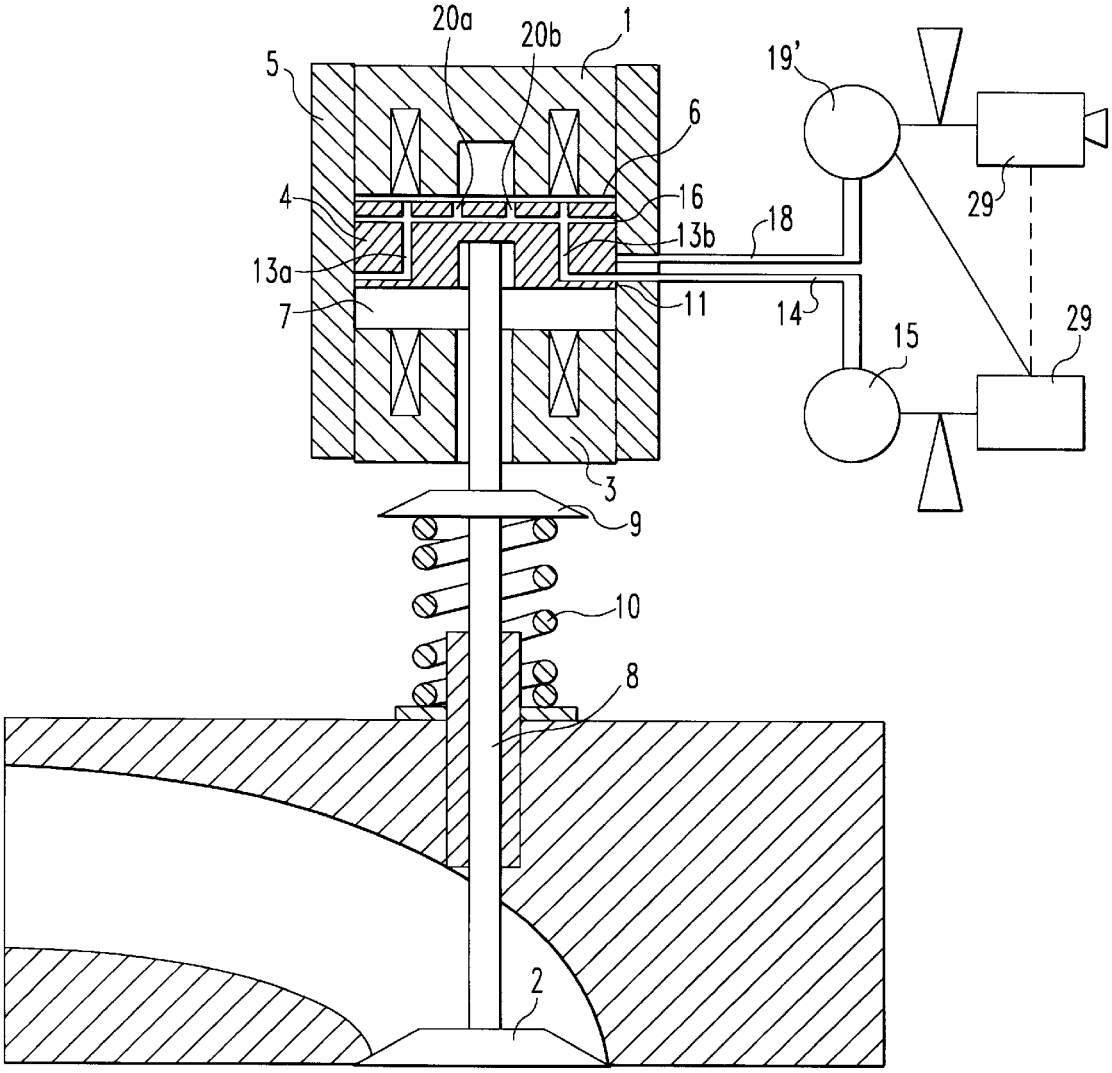

FIG. 5 shows an intermediate position, wherein the high pressure gas storage 15 as well as the low pressure gas receiver 19' are disconnected.

When approaching the upper end position, the valve 2 is again decelerated by the increasing gas pressure in the operating chamber 6. When the valve 2 is sufficiently close to its upper end position, the high pressure gas storage 15 is again connected to the operating chamber 6 by the control slot 11. This permits high pressure gas to enter the operating chamber whereby the upward movement of the valve 2 is further slowed. Finally, the upper electromagnet 1 is energized whereby the valve 2 or rather the operating piston 4 is held in its upper end position. At this point, an operating cycle of the valve 2 is completed.

The pressure storage 15 and the low pressure gas receiver 19' are operated by a two-stage compressor 29. In the upper compressor stage 29 as shown in the figures, air is sucked in under ambient pressure and is compressed and supplied to the low pressure gas receiver 19' generating therein a relatively low receiver pressure. From the low pressure receiver 19', the pre-compressed air is supplied to the second stage of the compressor (lower part 29), where the precompressed air is further compressed and supplied to the high pressure storage 15. The space between the operating piston 4 and the lower electromagnet is in open communication with the atmosphere (see the clearance between the valve shaft 8 and the electromagnet 3), so that the movement of the operating piston 4 is not affected by this space.

Figure 7:
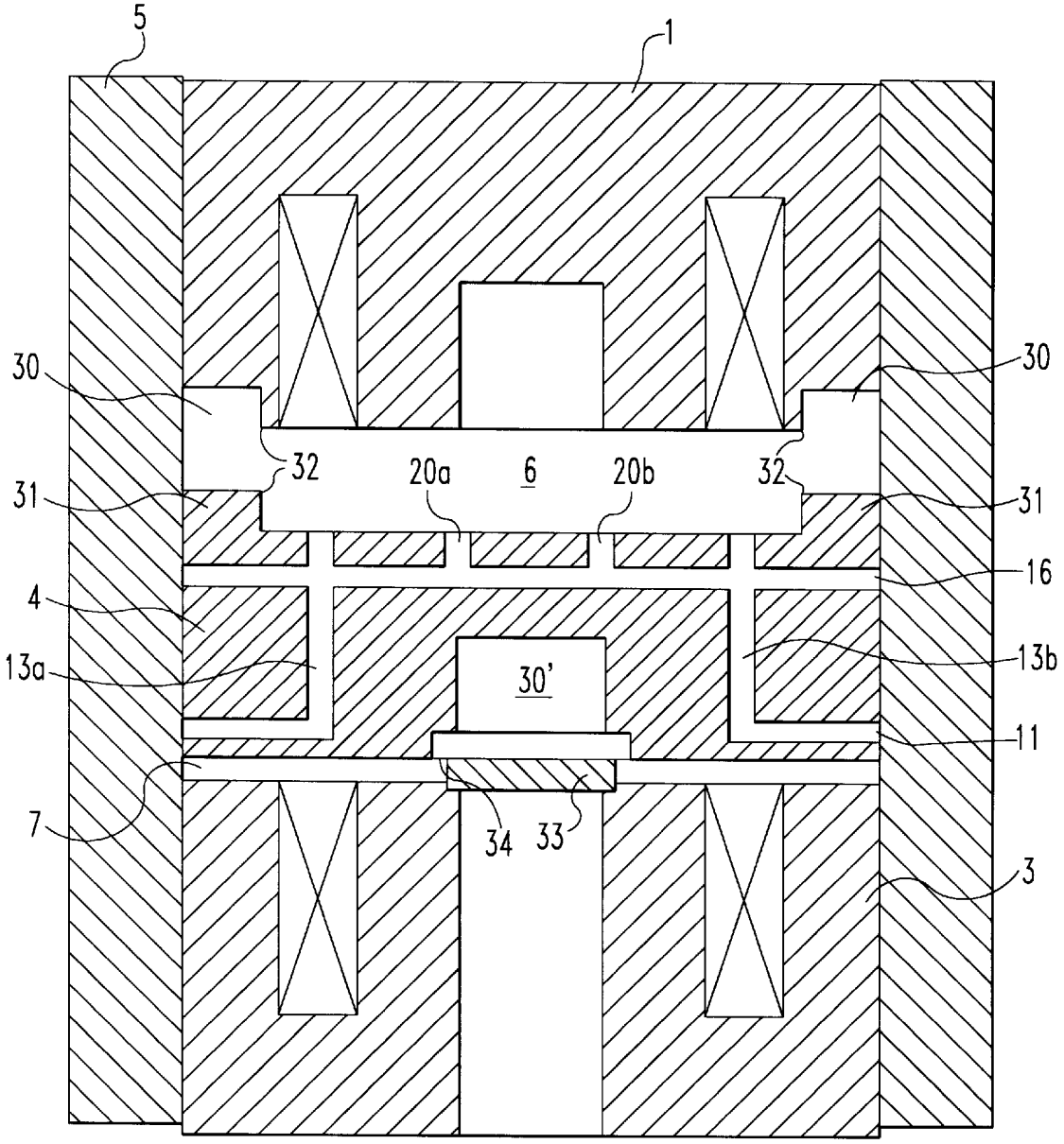
FIG. 7 shows an arrangement with pneumatic dampening of the valve movement at the end positions of the valve.

FIG. 7 is an enlarged view of the arrangement for explaining the pneumatic dampening of the valve when approaching its end positions. For simplification, only the parts which are important for the dampening are described. In order to achieve a smooth and quiet opening and closing at the end of a valve movement when the operating piston does not arrive at its end position with relatively low speed, but when the valve is operated with a large amount of excess energy, air pockets 30 are provided in the electromagnets 1 and/or 3 and the operating piston 4 for dampening the operating piston impact and reducing the noise generated thereby. As it is shown, the electromagnet 1 includes several air pockets 30 distributed over its circumference. Of course, the pockets may be annular in shape. The operating piston 4 has projections 31 adapted in size to the size of the air pockets 30, wherein the projections 31 are slightly smaller than the pockets 30 so as to provide a certain play and forming control edges 32 when the projections 31 enter the pockets 30. With this play, that is, by the control edges 32, the air release from the pockets 30 into the operating chamber 6 is restricted at the end of the movement of the valve 2 providing for a dampening effect.

For decelerating the valve at its lower open end position, there is provided another air pocket 30' in the operating piston 4 which cooperates with a damper plate 33 on the lower electromagnet 3. The diameter of this damper plate 33 is slightly smaller than the diameter of the opening of the air pocket 30'. In this way, during movement of the plate 33 into the air pocket 30', an annular gap with control edges 34 is formed by which air release from the air pocket 30' is restricted providing for a dampening of the movement of the valve 2 when reaching its lower position.

Figure 8:
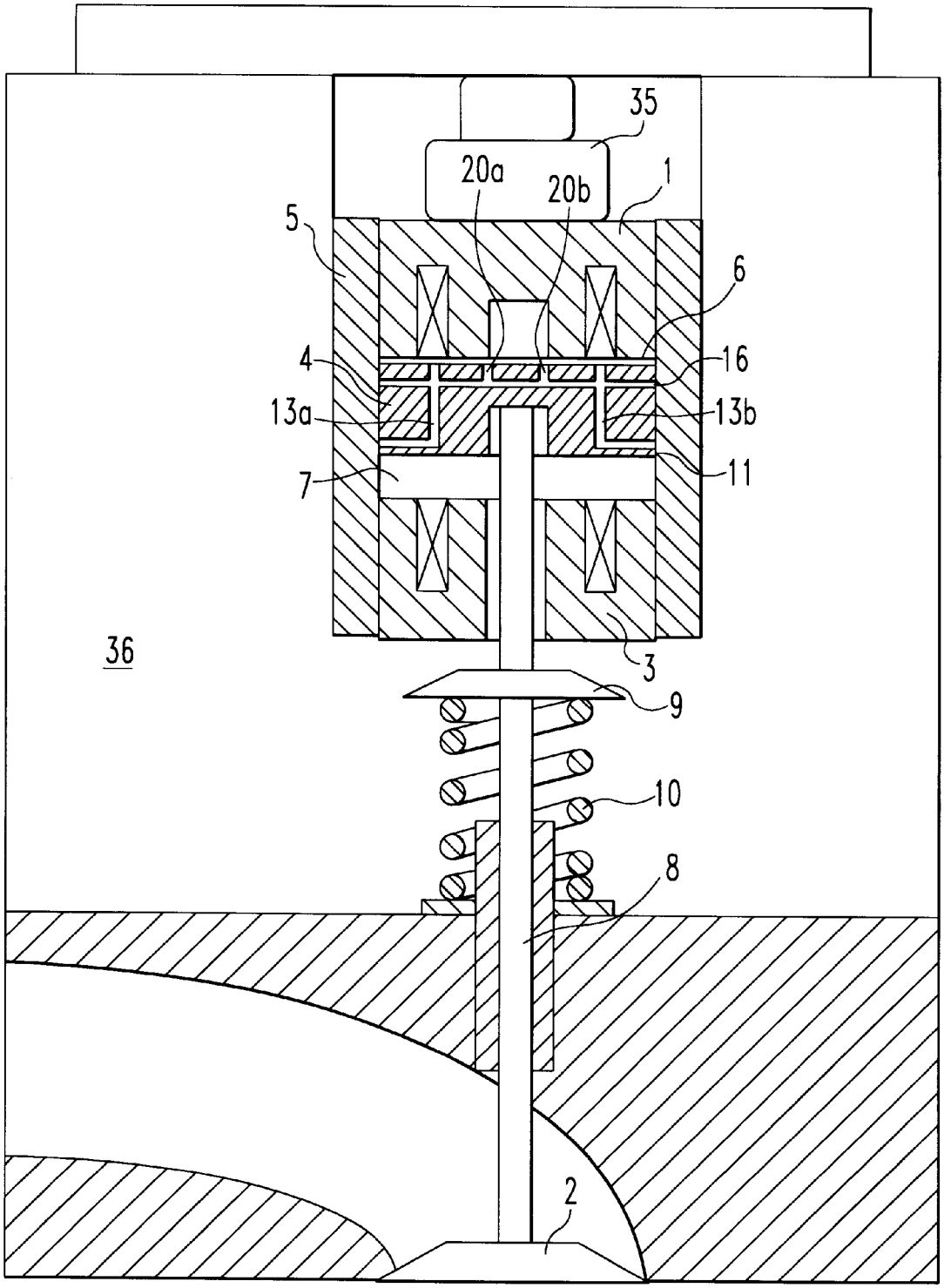
FIG. 8 shows the arrangement according to the invention with hydraulic valve clearance adjustment.

FIG. 8 shows, only schematically, a valve play compensation arrangement by way of a hydraulic valve play compensation arrangement 35. The electro-pneumatic operating arrangement can be disposed in the cylinderhead 36 as a floating unit. The hydraulic valve play compensation arrangement presses the whole unit downwardly with a small force. The valve 2 remains seated on its seat while the upper magnet 1 held down in play-free engagement with the operating piston 4 when the valve 2 is closed. In this way, the position of the upper electromagnet 1 is adapted to the position of the valve operating piston 4 by the hydraulic valve play compensation arrangement 35. In place of a hydraulic valve play compensation arrangement, a pneumatic valve play compensation arrangement could be provided. Since the operation of a hydraulic valve play compensation arrangement is well known in the art, it is not described here in detail.

Figure 9:
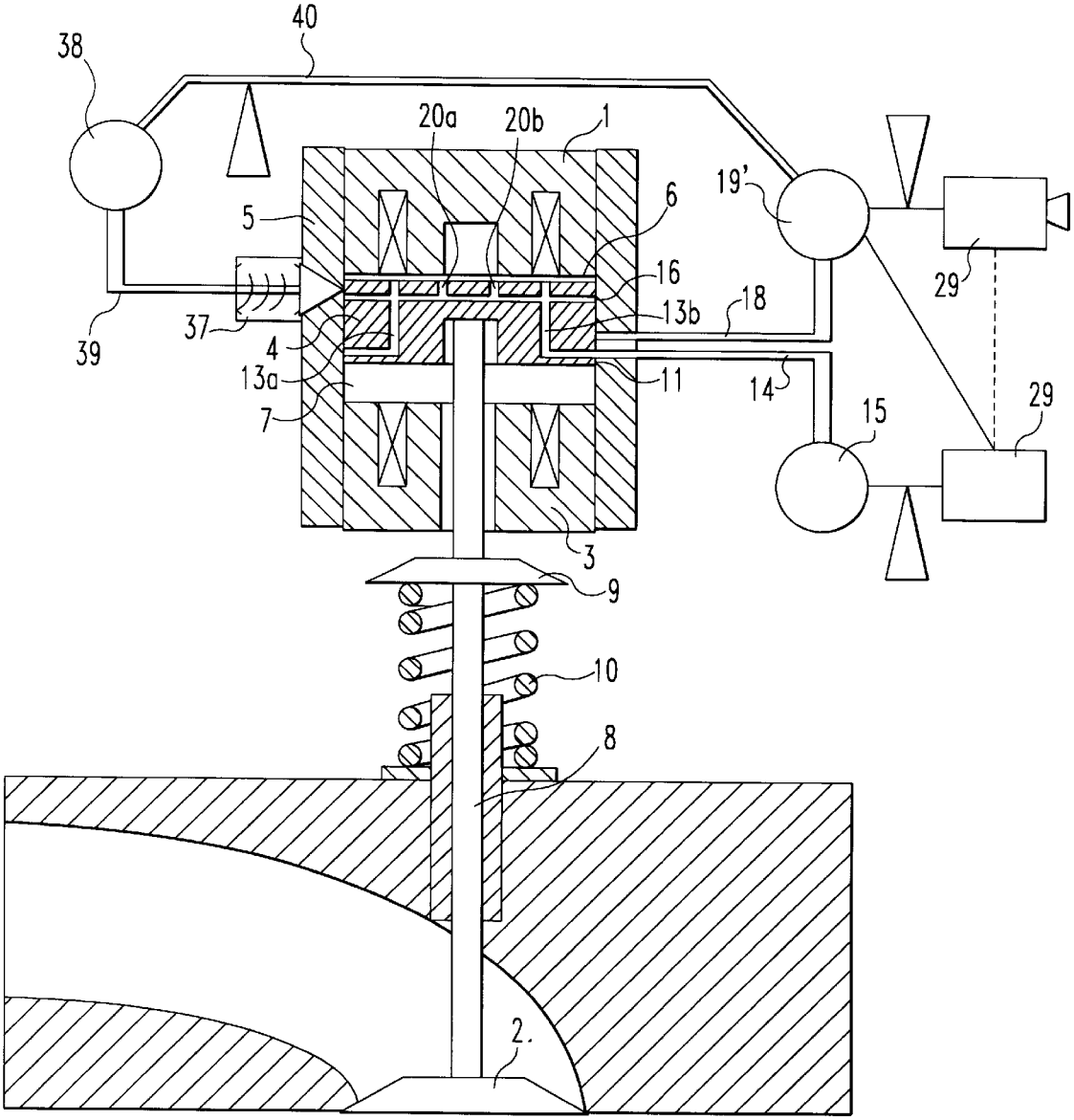
FIG. 9 shows an arrangement according to the invention with valve stroke limitation by a check valve.

FIG. 9 shows a stroke limitation by an adjustable check valve 37. The check valve 37 is provided for a case wherein the valve opening stroke is to be limited, that is, the valve 2 is not to be fully opened. The check valve 37 cooperates with a pressure storage container 38 to which it is connected by way of a pressure line 39. The pressure storage container 38 again is in communication with the low pressure gas receiver 19' by way of a control line 40. If the check valve 37 is subjected to an appropriate pressure from the pressure storage container 38, the check valve 37 remains closed and the system is operated in the normal manner. If the pressure in the pressure storage container 38 is reduced, the check valve 37 is opened as soon as the operating piston 4 moves past the check valve 37. Then air is released from the operating chamber 6 by way of the check valve 37 and the piston 4 together with the valve 2 does not reach the maximum lower end position adjacent the lower electromagnet 3, but stops already earlier.

Figure 10:
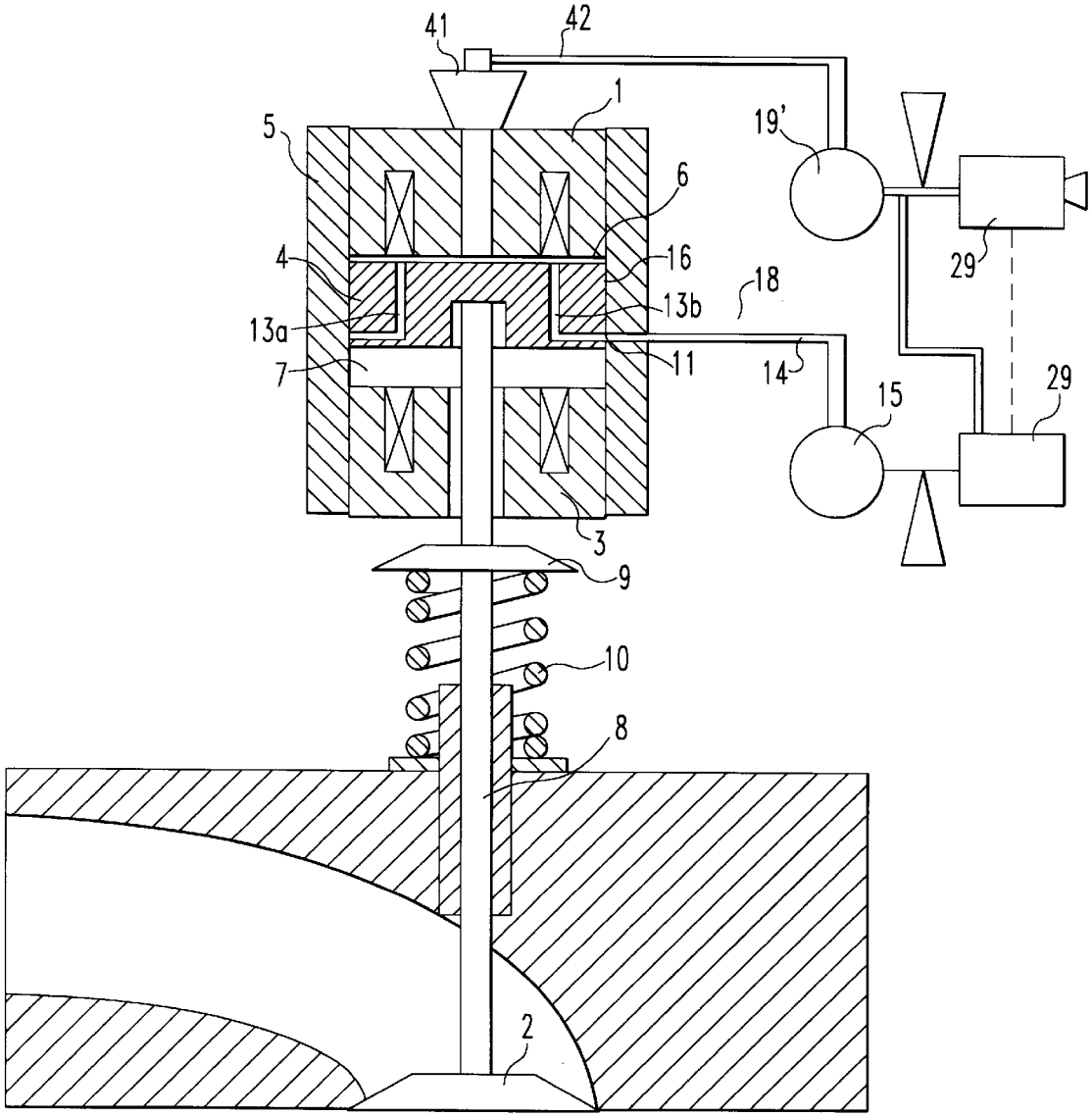
FIG. 10 shows an arrangement according to the invention with a control for the valve lift.

Another arrangement for increasing the control range for the stroke of the valve 2 is described with reference to FIG. 10. In this case, a pneumatic throttle valve 41 is provided which is electrically controlled. By means of the throttle valve 41, which is in communication with the pressurized gas receiver 19' by way of a line 42, the pressure in the operating chamber 6 can be reduced. As apparent, the throttle valve 41 together with the line 42 takes over the function of the control slot 16 and the communication conduit 18 described earlier. With the pressure reduction in the operating chamber 6, the operating piston 4 no longer reaches its lower end position at the electromagnet 3. The travel length of the operating piston 4 is therefore shorter than the maximum opening stroke of the valve. To insure that the valve 2 can return to its upper end position, pressure must be released by the electrically controlled pneumatic throttle valve 41 during movement of the operating piston 4. As a result, the energy required from the closing spring 10 for closing the valve is reduced. In this way, the operating piston 4 can return to its upper end position in which the valve 2 is closed.

With this arrangement, running of the engine at high engine speed and low engine power output can be improved.

Figure 11:
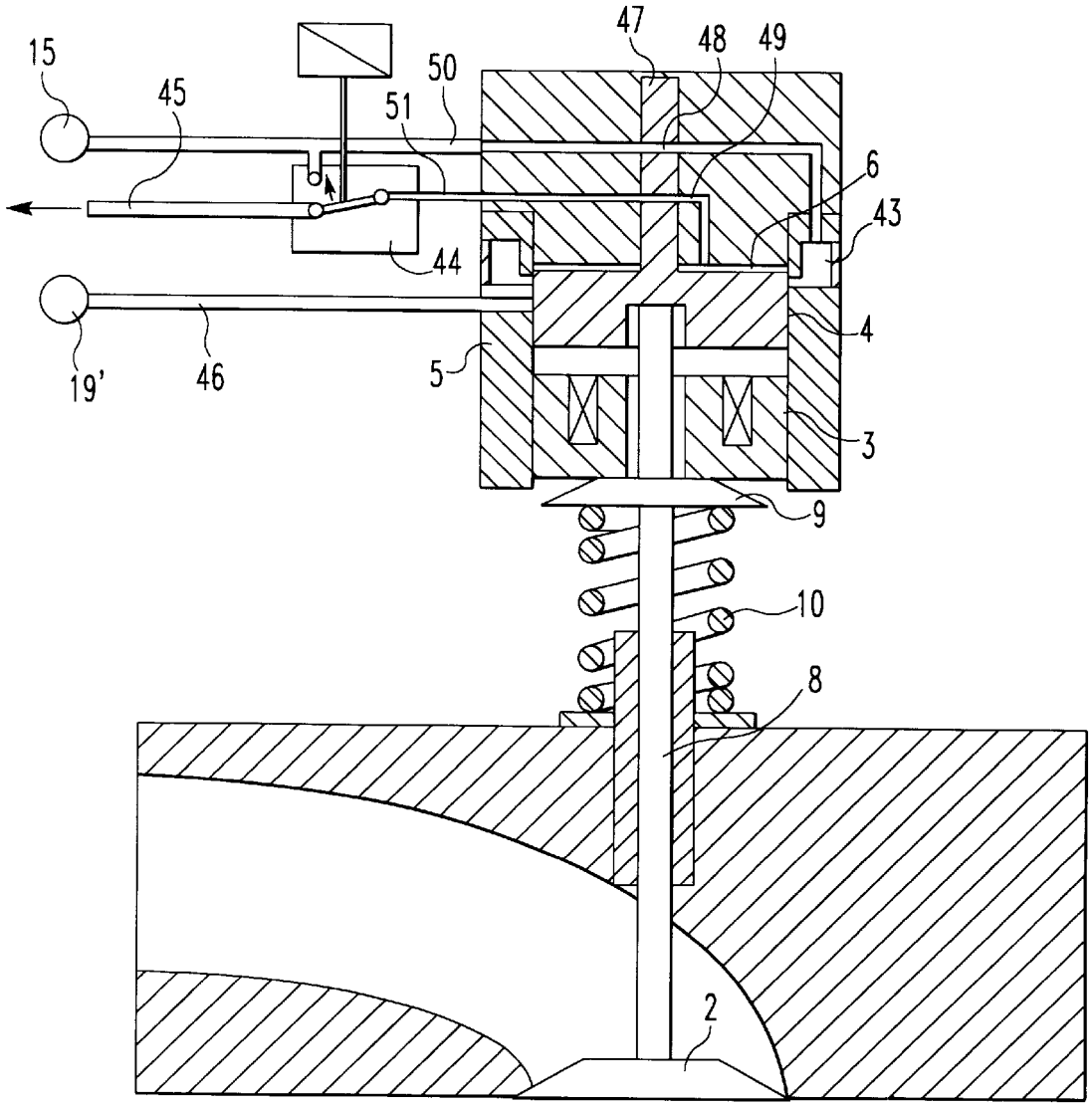
FIG. 11 shows a third embodiment of the arrangement according to the invention.

FIG. 11 shows, in principle, another embodiment of the arrangement as shown in the FIGS. 2 to 6. The main difference resides in the fact that the upper magnet 1 which is responsible for holding the valve in the closed position has been eliminated and only the lower electromagnet 3, which holds the valve in an open position is provided. A second difference in the design resides in the fact that, with this system, a kind of pneumatic toggle spring is provided. It includes an annular storage space 43 in which air under pressure is disposed. The air is released by the movement of the piston 4. Furthermore, there is provided a pneumatically or magnetically operated switch-over valve 44 which can provide for communication selectively between the high pressure storage 15 and the operating chamber 6 or the operating chamber 6 and a vent line 45. A pressure line 46 provides for communication with the low pressure storage 19'. The operating piston 4 includes an upwardly extending rod-like projection 47 with transverse bores 48 and 49, which, depending on the position of the operating piston 4, provide for communication between the high pressure storage 15 and the annular storage space 43 by way of a pressure line 50 and for communication between the switch-over valve 44 and the operating chamber 6 by way of a line 51. If the switch-over valve 44 is switched from the position shown in the figure in the direction as indicated by the arrow, communication is established between the high pressure storage 15 and the line 51 and consequently the operating chamber 6 when the operating piston is in its top end position. The operating piston is then moved downwardly whereby, after a short travel distance, communication is established between the annular storage space 43 which contains pressurized air and the operating chamber 6. The highly pressurized air from the annular chamber is then released into the operating chamber 6 and accelerates the piston 4 downwardly into a position close to the lower electromagnet 3 by which the piston 4 is caught and held as described with regard to the earlier embodiments. As soon as the operating piston is moved out of its upper end position, the annular storage space 43 is uncoupled from the high pressure storage 15 since the transverse bore 48 is out of alignment with the pressure line 50.

The switch-over valve 44 is a 3/2 way valve. Upon switch-over from the lower to the upper position, pressurized air flows into the operating chamber 6 by way of the line 51, but only for a short period of time until the piston 4 moves downwardly since the line 51 is interrupted as the transverse bore 49 in the rod-like projection 47 of the operating piston 4 is out of alignment with the bore 51. However, because the operating chamber 6 is now in communication with the annular storage space 43, the piston 4 continues to be moved downwardly. Consequently, the annular storage space 43 assumes the function of a pneumatic spring.

In the lower position of the valve 2, the piston 4 is retained by the electromagnet 3 and pressure is released from the operating chamber 6 by way of the pressure line 46 to the low pressure receiver 19' in a manner as described earlier. The low pressure storage space or receiver 19' is connected as soon as the pressure line is exposed by the upper edge of the piston 4.

Upon de-energization of the electromagnet 3, the piston 4 is again accelerated upwardly by the closing spring 10. During this movement, the operating piston passes the control edge at the annular storage space 43 to close the storage space 43 and, at the same time, communication is established between the operating chamber 6 and the vent line 45 by way of the line 51 and the transverse bore 49 assuming that the switch-over valve 44 is in the lower position as shown in the figure.

What is claimed is:

1. An operating arrangement for a gas change valve of an internal combustion engine comprising an electromagnetic structure having an armature firmly connected to said valve for movement therewith, said armature forming an operating piston disposed in a cylinder for reciprocating therein between an upper end position in which said valve is closed and a lower end position in which said valve is open, said piston forming with said cylinder at least one operating chamber, at least a first electromagnet arranged adjacent the lower end position of said armature for retaining said armature when energized to maintain said valve in an open position, a spring arranged so as to bias said operating piston into a valve closing position and electro-pneumatic pressure means effective on said at least one operating chamber for actuating said piston in a valve opening or, respectively, a valve closing direction.

2. An arrangement according to claim 1, wherein a second electromagnet is provided adjacent the upper end position of said armature, which, when energized holds said valve in a closed position.

3. An arrangement according to claim 1, wherein operating chambers are disposed at both side of said operating piston.

4. An arrangement according to claim 1, wherein said operating piston has control edges and control bores for placing said at least one operating chamber in communication with said pneumatic pressure means.

5. An arrangement according to claim 1, wherein air pockets are provided which can be placed in communication with said operating chamber by control edges of said operating piston.

6. An arrangement according to claim 1, wherein a hydraulic valve play adjustment structure is provided for compensating for valve play.

7. An arrangement according to claim 1, wherein said electro-pneumatic pressure means includes a stroke limiting structure comprising a check valve which is in communication with said operating chamber and which is exposed to gas pressure of a pressure storage container.

8. An arrangement according to claim 1, wherein, for controlling the stroke of said operating piston, a pneumatic throttle valve is provided capable of placing said operating chamber in communication with a low pressure area for discharging pressurized air from said operating chamber.

9. An arrangement according to claim 1, wherein said operating chamber is provided with a safety valve arrangement by way of which the operating chamber can be vented if the electro-pneumatic pressure means fails.

10. An arrangement according to claim 1, wherein an annular storage space is provided which can be placed in communication with said operating chamber and which also can be placed in communication with a high pressure storage by control passages operated by said operating piston, and a switch-over valve is provided for placing said operating chamber selectively in communication with a high pressure line or a vent line.

* * * * *